US007124763B2

(12) United States Patent
Hafemann

(10) Patent No.: US 7,124,763 B2
(45) Date of Patent: Oct. 24, 2006

(54) STYLING AND CURLING HAIRBRUSH

(75) Inventor: Klaus Hafemann, Essen (DE)

(73) Assignee: WIK Far East, LTD, Hong Kong (HK)

( * ) Notice: Subject to any disclaimer, the term of this patent is extended or adjusted under 35 U.S.C. 154(b) by 454 days.

(21) Appl. No.: 10/725,765

(22) Filed: Dec. 2, 2003

(65) Prior Publication Data

US 2004/0129289 A1 Jul. 8, 2004

(30) Foreign Application Priority Data

Dec. 3, 2002 (DE) ..... 202 18 783 U

(51) Int. Cl.
*A45D 6/06* (2006.01)

(52) U.S. Cl. ..... 132/228; 34/96; 132/272

(58) Field of Classification Search ..... 132/227–229, 132/237, 120, 272, 271; 34/96, 97, 101, 34/283

See application file for complete search history.

(56) References Cited

U.S. PATENT DOCUMENTS

| | | | | |
|---|---|---|---|---|
| 3,563,250 A | | 2/1971 | DeFalandre | |
| 3,890,984 A | * | 6/1975 | Lesetar | 132/271 |
| 3,990,460 A | * | 11/1976 | Shalvoy | 132/229 |
| 4,250,902 A | | 2/1981 | Ihara | |
| 5,212,366 A | * | 5/1993 | McDougall | 219/222 |
| 6,363,215 B1 | * | 3/2002 | Cafaro | 392/384 |

FOREIGN PATENT DOCUMENTS

| | | |
|---|---|---|
| DE | 2535421 | 3/1976 |
| DE | 26 41 811 | 3/1977 |
| DE | 2551508 | 5/1977 |
| DE | 7925952 | 1/1980 |
| DE | 20218783.7 | 12/2002 |
| DE | 03021790 | 1/2004 |
| FR | 2422358 | 11/1979 |
| FR | 2493689 | 5/1982 |

* cited by examiner

*Primary Examiner*—Patricia Bianco
*Assistant Examiner*—Rachel Running
(74) *Attorney, Agent, or Firm*—Patent Law Offices of Rick Martin, PC; Margaret Polson

(57) ABSTRACT

A styling and curling hairbrush 1 having an elongated tubular body 6 with an interior hollow volume along the longitudinal extent to forming air channel 7. A hot air stream 17 enters the open end of body 6. Body 6 has air exit openings 9 connecting the air channel 7 with the outer shell surface of the tubular body 6. Several bristle rows $B_1$–$B_3$ are distributed circumferentially on the tubular body. An air stream divider 3 is in front of the bristle rows $B_1$–$B_3$. A hot air stream 17 is divided by the air stream divider into an air stream 18 flowing into the air channel 7 and one flowing along the outer shell surface of the tubular body 6. The bristle rows $B_1$–$B_3$ of the brush 1 are spaced apart from one another. Each bristle row $B_1$–$B_3$ is next to an air guidance element $L_1$–$L_3$ closed in the radial direction and forming at least one flow channel 12, 16 and is open toward at least an adjacent bristle row $B_1$, $B_2$, $B_3$.

24 Claims, 2 Drawing Sheets

STYLING AND CURLING HAIRBRUSH

CROSS REFERENCE APPLICATIONS

This application claims priority from German application no. 202 18 783.7 filed Dec. 3, 2002.

FIELD OF INVENTION

The present invention relates to a styling and curling hairbrush with an elongated tubular body for attachment on a hot air blower.

BACKGROUND OF THE INVENTION

Styling brushes which can be attached to a hot air blower or permanently mounted as part of a hair styling tool are well known in the art. Generally, the body of the brush had an inner hollow volume following the longitudinal extent of the body forming an air channel to act as a collector. The air channel has an open end to allow a hot air stream to flow into the air channel. Air escape openings connect the air channel with the outer shell surface of the tubular body. Several rows of bristles are distributed circumferentially with respect to the tubular body. The rows of bristles can be formed by individual bristle elements of synthetic material or steel, or by tufts of bristles. The individual bristle rows are disposed along the longitudinal extent of the tubular body.

The flow of hot air is a limiting factor in the amount of heat supplied to the hair to be shaped. This can be limited when desirable close spacing of the individual bristles prevents further perforation of the tubular body. In order to supply more heat to the hair to be shaped prior art styling and curling hairbrushes have an additional air stream flowing along the shell surface of the tubular body. To accomplish this the hairbrush has an air stream divider to direct a portion of the hot air stream flowing to the hairbrush onto the outside of the tubular body. This air stream flows through the individual bristles or bristle rows at their base.

The prior art curling hairbrushes do shape hair with the heat supplied via the hot air stream. However, a limitation of the prior art curling hairbrush is that hair which is next to the exit openings of the outer air stream gets more heat than the hair that is farther from the air exit openings. This is caused by the hair in close proximity to the air exit openings blocking the path of the air stream to the more remote hair and/or hair bristles. Even if it may occasionally be desired to attain a different shaping result over the useful length of such a hairbrush within the same shaping process, it would be desirable to have a styling and curling hairbrush available with which shaping results are identical over the entire useful length.

Building on the discussed prior art, the invention addresses the problem of a styling and curling hairbrush in which the disadvantages listed under the discussed prior art are at least largely avoided.

This problem is solved in the present invention when the bristle rows of the brush are spaced apart. The individual bristle rows are disposed next to an air guidance element which is closed in the radial direction and forms an air flow channel open to the adjacent bristle row or rows.

SUMMARY OF THE INVENTION

The primary aspect of the present invention is to provide a hot air styling hair brush where the heat provided to the hair to be styled is largely even over the effective length of the brush.

Other aspects of this invention will appear from the following description and appended claims, reference being made to the accompanying drawings forming a part of this specification wherein like reference characters designate corresponding parts in the several views.

In the present invention the body of the brush has an inner hollow volume following the longitudinal extent of the body forming an air channel forming a collector. The air channel is open at one end to allow a hot air stream to flow into the air channel. Air escape openings connect the air channel with the outer shell surface of the tubular body. Several rows of bristles are distributed circumferentially with respect to the tubular body. The bristle rows are spaced apart with respect to one another.

Between each bristle row is an air guidance element which is parallel to the bristle rows and also follows the longitudinal extent of the tubular body. Each air guidance element forms an airflow channel which is closed in the radial direction. The channel is open toward at least one adjacent bristle row or has openings in this direction. The air guidance element forms a guide sheet held at a spacing apart from the tubular body, beneath which a sheathing air stream can be transported. The guide sheet also keeps open the flow channel formed by the air guidance elements when the hairbrush is being used. Hair does not block the longitudinal flow in air guidance channel when the brush is used, even if the hair is tightly wrapped around the body.

Several such air guidance elements are disposed about the tubular body. The spacing of the air guidance element prevents hair from wrapping into the base of the bristle rows. The keeps both the flow channels of the air guidance elements and the base of the bristle rows are kept free for airflow. This allows a sheathing air stream acting directly onto the bristle rows when the hairbrush is used to flow along beneath the hair held away from the outer shell surface and to more uniformly transfer the head to the hair. The sheathing substream in each flow channel forms a heat reservoir so that the hair in the area of the useful surface of the brush receives sufficient heat.

In one embodiment the flow channels formed by the air guidance elements are closed at their free end or in the proximity of their free end so that the occurring eddies enhance the heat transfer from the air stream to the hair.

Additionally, to supplement the sheathing air stream, hot air also exits from the interior of the tubular body at air exit openings following the longitudinal extent of the tubular body of the brush. Therefore, the sheathing air stream is both deflected toward the hair to be shaped and turbulences are generated which enhance the heat transfer in the region of the bristle rows.

In a preferred embodiment the air guidance elements are fabricated of metal, for example of aluminum. When the brush is being used these elements store heat, which is transferred from the outside of the air guidance elements to the hair in contact with them. This means that the air guidance elements serve both for guiding sheathing air streams and for forming elements which function as heat plates.

The segments projecting radially outwardly of the air guidance elements preferably form a slotted sleeve, with one bristle row each disposed in the slotted regions. The air guidance element can be structured differently. In one formation, in which such an air guidance element is open substantially directed to an adjacent bristle row, it has the form of an O and is curved corresponding to the curvature of the outer shell surface of the tubular body. It can also be provided that, while the air guidance elements are closed in the radial direction they are open toward both adjacent bristle rows. In this case such an air guidance element is developed to have the form of a T in cross section. Such an air guidance element forms consequently two flow channels.

The bristle rows and also the air guidance elements of the styling and curling hairbrush can be developed such that they extend in straight lines following the longitudinal extent of the tubular body. However, these can also be disposed such that they encompass the tubular body in the manner of a spiral.

The styling and curling brush can be associated with a hot-air blower disposed in a handle. It is also possible to develop this hairbrush with a coupling piece so that it is an attachment onto a handle with a hot-air blower, commonly knows a as hair dryer. The hot-air blower can subsequently also be employed for other hair shaping attachments.

DETAILED DESCRIPTION OF THE DRAWINGS

Figure 1:
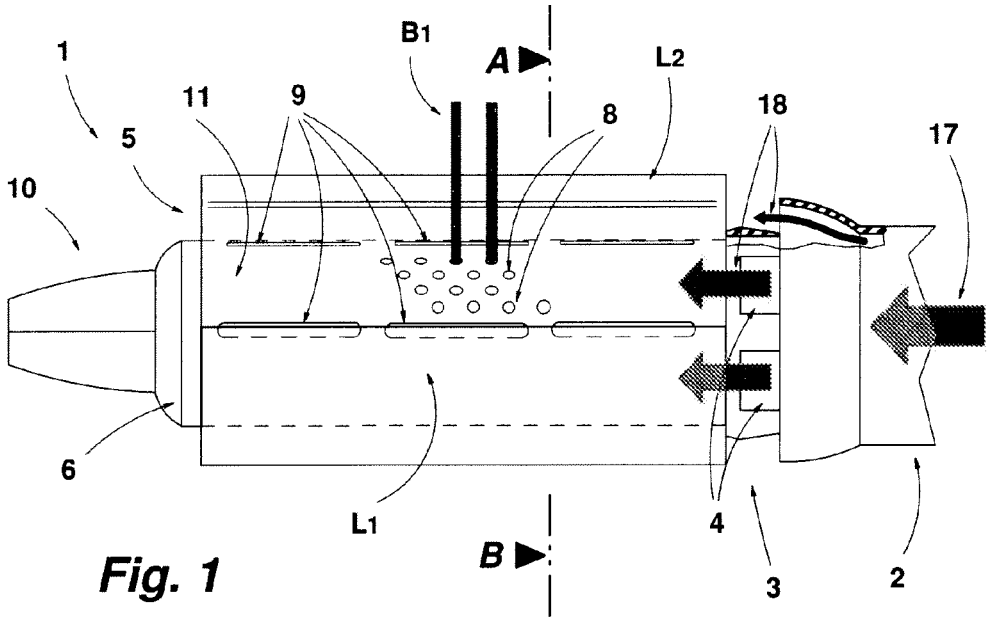
FIG. 1 is a schematic side view of a styling and curling hairbrush.

Referring to FIG. 1, a styling and curling hairbrush 1, which in the depicted embodiment is an attachment for a hot-air producing hand-held device, has a coupling piece 2, with which the hairbrush 1 can be connected to a grip piece (not shown) including a hot air blower. The coupling piece 2 is developed as an annular body and can be fitted on to the grip piece. The hairbrush 1 further comprises an air stream divider 3 next to the coupling piece 2, which divides a hot air stream introduced into the coupling piece 2 into sheathing air stream exiting through several circumferentially distributed openings 4 and in to the longitudinal extent of the hairbrush 1.

Figure 2:
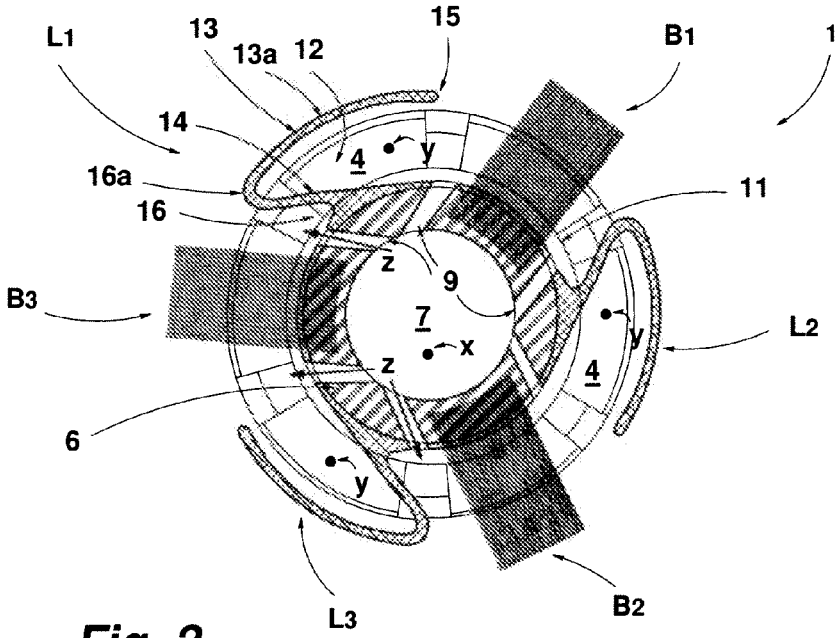
FIG. 2 a cross-sectional view of the hairbrush taken along line A-B of FIG. 1.

In the direction toward the free end of the hairbrush 1 the air stream divider 3 is adjoined by the brush section 5 of the hairbrush 1. The brush section 5—as shown in the cross section of FIG. 2—comprises a cylindrical tube 6, whose inner hollow volume forms an air channel 7.

In the tube 6 bristle tufts are anchored in three bristle rows $B_1$, $B_2$ and $B_3$ disposed parallel to one another. The bristle rows substantially follow the longitudinal extent of the hairbrush 1. A bristle row can be formed by a single row of bristles or it can also be formed by several parallel bristle rows and/or offset with respect to one another. Or the bristle row arrangement can be disposed in groups circumferentially with respect to the tubular body, with each group being spaced apart from the adjacent group.

To simplify the drawing for clarity, FIG. 1 shows the hairbrush 1 with only a few bristle tufts indicated. These emerge from the shell surface of the bristle section 5 through the openings 8 only shown in one region. The air channel 7 of the tube 6 is connected via several air exit openings 9, developed in the form of elongated holes, with the shell surface of the bristle section 5. Tube 6 is closed toward its free end forming a taper 10.

A sleeve 11 is set torsionally tight onto the tube 6, which is shown with three air guidance elements $L_1$, $L_2$, $L_3$. The inner section of sleeve 11 is in contact on tube 6 and forms a shell around tube 6 with the same properties as tube 6. The air exit openings 9 also penetrate the sleeve 11 and the sleeve 11 has the openings 8 for allowing the bristle tufts to penetrate through them.

In the following the air guidance element $L_1$ is described in further detail. The two further air guidance elements $L_2$ and $L_3$ are structured correspondingly. The air guidance element $L_1$ is formed into a curved U-form flow channel 12. The channel is closed in the radial direction with respect to tube 6 through an outer segment 13 of air guidance element $L_1$. This outer segment 13 of air guidance element $L_1$ assumes the function of a guide sheet. The outer segment 13 is connected by base segment 14 with the shell of sleeve 11 encompassing tube 6. The outer segment 13 is curved corresponding to its distance from the shell surface of tube 6 and corresponding to its concentric disposition to tube 6. Like the attachment of base segment 14 to outer segment 13, the front edge 15 is rounded off to avoid damage to the hair to be shaped. The flow channel 12 formed by air guidance element $L_1$ is open in the tangential direction and consequently toward bristle row $B_1$.

Due to the curved formation of the air guidance element $L_1$, on the backside of flow channel 12 a further flow channel 16 is formed. The outer edge 16*a* of flow channel 16 is formed by base segment 14. In the depicted embodiment example flow channel 12 is smaller than flow channel 12. Flow channel 16 is open toward the other bristle row $B_3$.

Sleeve 14 and air guidance elements $L_1$–$L_3$ are preferentially produced of aluminum, for example by way of extrusion molding. Other suitable materials could be used.

During operation of the hairbrush 1 a hot air stream 17 flows via the coupling piece 2 and the air stream divider 3 into air channel 7 and out through openings 4. This divides the air stream 17 into an air stream flowing into air channel 7, shown by vector X and the sheathing airs streams flowing through air channels 12 and 16, shown by vector Y.

If a strand of hair is wound around brush section 5 the hair concentrically encompasses tube 6 and is in contact with the outer surface 13*a* of the outer segments 13 of air guidance elements $L_1$–$L_3$. The strand of hair is held at a spacing from the base surface of sleeve 11 by the air guidance elements $L_1$–$L_3$. Consequently, hot air can be supplied to the strand of hair to be shaped from the air exit openings 9 of the air channel 7, as shown by arrow Z.

Simultaneously the hair strand is exposed to the sheathing air stream, which is transported in the flow channels 16 of the individual air guidance elements $L_1$–$L_3$ parallel to the longitudinal extent of the bristle rows $B_1$–$B_3$. The heat transported in this sheathing air stream 18 is sufficient to warm the hair strand to be shaped uniformly over its entire width. The meeting of the hot air streams transported from the air exit openings 9 and the flow channels 12, 16 results in turbulences, such that heat transfer from the air stream onto the hair is facilitated.

Forming sleeve 11 and air guidance elements $L_1$–$L_3$ of aluminum helps the warming process of the hair due to the heat conducting properties of aluminum. During operation of the hairbrush 1 these aluminum component parts are warmed by the hot air stream transported through the flow channels 12, 16 and this heat is transferred to the hair strand due to the large-area contact on the hair strand to be shaped.

Although the preferred embodiment is described having three rows of bristles and three air guidance elements, it is to be understood that more or less could be used, depending on design considerations.

The description of the invention elucidates that the handling of the described styling and curling hairbrush, compared to prior art, is not only improved but also that a better hair shaping result can be attained. In the embodiment example the styling and curling hairbrush has been described with the bristle rows stationary. The invention can also be realized in which rows of bristles are retractably disposed, such that these can be retracted into the tube for detaching the hairbrush from the shaped strand or portion of hair.

Figure 3:
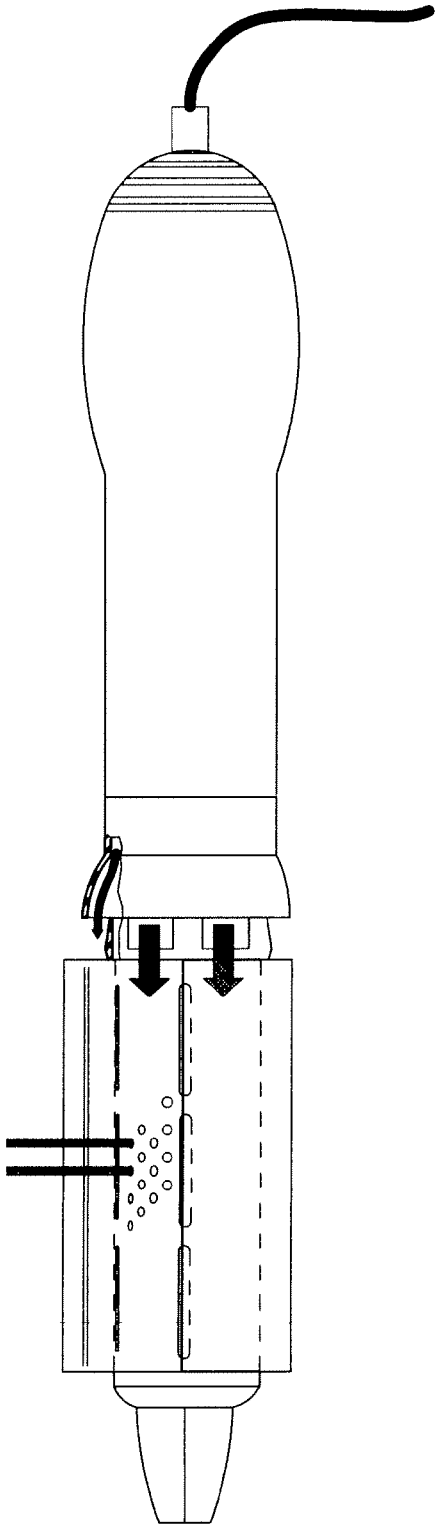
FIG. 3 is a schematic side view of the present invention with the hot air blower integrated into the handle Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

FIG. 3 shows the present invention with the brush section 5 is part of an integrated hot air styling brush 101 with the hot air blower mounted in the handle 102. The coupling piece 201 is attached to the handle 102. All other pieces are identical.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

LIST OF REFERENCE SYMBOLS

1 Hairbrush
2 Coupling piece
3 Air stream divider
4 Opening
5 Brush section
6 Tube
7 Air channel
8 Opening
9 Air exit opening
10 Taper
11 Sleeve
12 Flow channel
13 Outer segment
14 Base segment
15 Edge
16 Flow channel
17 Hot air stream
18 sheathing air stream
101 hot air styling brush
102 handle
201 coupling piece
$B_1$–$B_3$ Bristle row
$L_1$–$L_3$ Air guidance element

I claim:

1. A styling and curling hairbrush comprising:

an elongated tubular body having an outer shell surface and a longitudinal interior hollow forming an air channel;

said air channel being open at one end and closed at the opposite end;

air exit openings extending from the air channel to the outer shell surface;

at least two bristle rows distributed circumferentially with respect to the tubular body and spaced apart from each other;

at least two air guidance elements mounted between and substantially parallel to the bristle rows;

said air guidance elements being closed in the radial direction and forming at least one flow channel and open or having openings at least toward one adjacent bristle row; and an air stream divider mounted at the open end of the air channel, said air stream divider adapted to divide an air stream into an air stream flowing into the air channel and an air stream flowing along the flow channel and thereby along on the outer shell surface of the tubular body.

2. A styling and curling hairbrush as claimed in claim 1, wherein the air guidance elements further comprise a radially directed outer segment forming a slotted sleeve with one bristle row each disposed in a slot.

3. A styling and curling hairbrush as claimed in claim 2, wherein the outer segments of the air guidance elements are disposed concentrically with respect to the tubular body.

4. A styling and curling hairbrush as claimed in claim 2 or 3, wherein the outer segments of the air guidance elements are each connected by a base segment with a sleeve which encompasses and fastens on to the tubular body and the bristle rows penetrating the sleeve.

5. A styling and curling hairbrush as claimed in one of claims 1 to 3, wherein the flow channels formed by the air guidance elements have a cross sectional area in the form of a U and are adapted to the curvature of the outside of the tubular body.

6. A styling and curling hairbrush as claimed in claim 4, wherein the flow channels formed by the air guidance elements have a cross sectional area in the form of a U and are adapted to the curvature of the outside of the tubular body.

7. A styling and curling hairbrush as claimed in one of claims 1 to 3, wherein the air flow channels formed by air guidance elements are closed at ends directed toward the free end of the brush.

8. A styling and curling hairbrush as claimed in claim 4, wherein the airflow channels formed by air guidance elements are closed at ends directed toward the free end of the brush.

9. A styling and curling hairbrush as claimed in claim 5, wherein the airflow channels formed by air guidance elements are closed at ends directed toward the free end of the brush.

10. A styling and curling hairbrush as claimed in claim 6, wherein the airflow channels formed by air guidance elements are closed at ends directed toward the free end of the brush.

11. A styling and curling hairbrush as claimed in one of claims 1 to 3, further comprising a hot air blower disposed in a handle.

12. A styling and curling hairbrush as claimed in claim 4, further comprising a hot air blower disposed in a handle.

13. A styling and curling hairbrush as claimed in claim 5, further comprising a hot air blower disposed in a handle.

14. A styling and curling hairbrush as claimed in claim 6, further comprising a hot air blower disposed in a handle.

15. A styling and curling hairbrush as claimed in claim 7, further comprising a hot air blower disposed in a handle.

16. A styling and curling hairbrush as claimed in claim 8, further comprising a hot air blower disposed in a handle.

17. A styling and curling hairbrush as claimed in claim 9, further comprising a hot air blower disposed in a handle.

18. A styling and curling hairbrush as claimed in one of claims 1 to 3, wherein the hairbrush further comprises a coupling piece with which it can be set as an attachment onto a hand-held device with a hot air blower.

19. A styling and curling hairbrush as claimed in claim 4, wherein the hairbrush further comprises a coupling piece with which it can be set as an attachment onto a hand-held device with a hot air blower.

20. A styling and curling hairbrush as claimed in claim 5, wherein the hairbrush further comprises a coupling piece with which it can be set as an attachment onto a hand-held device with a hot air blower.

21. A styling and curling hairbrush as claimed in claim 6, wherein the hairbrush further comprises a coupling piece with which it can be set as an attachment onto a hand-held device with a hot air blower.

22. A styling and curling hairbrush as claimed in claim 7, wherein the hairbrush further comprises a coupling piece with which it can be set as an attachment onto a hand-held device with a hot air blower.

23. A styling and curling hairbrush as claimed in claim 8, wherein the hairbrush further comprises a coupling piece with which it can be set as an attachment onto a hand-held device with a hot air blower.

24. A styling and curling hairbrush as claimed in claim 9, wherein the hairbrush further comprises a coupling piece with which it can be set as an attachment onto a hand-held device with a hot air blower.

* * * * *